US008453881B2

(12) United States Patent
Chapin

(10) Patent No.: US 8,453,881 B2
(45) Date of Patent: Jun. 4, 2013

(54) BOTTLE MOUNTING ASSEMBLY FOR REFRIGERATED DISPENSERS

(75) Inventor: Michael L. Chapin, New York, NY (US)

(73) Assignee: Tap Machine Inc. NY (US)

( * ) Notice: Subject to any disclaimer, the term of this patent is extended or adjusted under 35 U.S.C. 154(b) by 1166 days.

(21) Appl. No.: 12/048,618

(22) Filed: Mar. 14, 2008

(65) Prior Publication Data

US 2009/0230147 A1 Sep. 17, 2009

(51) Int. Cl.
*B67D 7/80* (2010.01)

(52) U.S. Cl.
USPC ..... 222/146.6; 222/129.4; 222/132; 222/135

(58) Field of Classification Search
USPC ..... 222/146.6, 132, 129.4; 251/336, 251/337, 360, 149.6, 149.7; 285/24, 913, 285/914
See application file for complete search history.

(56) References Cited

U.S. PATENT DOCUMENTS

| | | | | | |
|---|---|---|---|---|---|
| 2,089,168 | A * | 8/1937 | Brown | 403/259 |
| 2,322,877 | A * | 6/1943 | Parker | 251/149.6 |
| 2,453,080 | A * | 11/1948 | Shimp | 222/185.1 |
| 3,930,598 | A * | 1/1976 | Slagle | 222/129.4 |
| 5,165,733 | A * | 11/1992 | Sampson | 285/253 |
| 5,427,276 | A | 6/1995 | Knuettel, II et al. | |
| 5,456,387 | A * | 10/1995 | Trewhella | 222/146.6 |
| 5,494,195 | A | 2/1996 | Knuettel, II et al. | |
| 6,409,150 | B2 * | 6/2002 | Sullivan et al. | 251/360 |
| 2003/0057699 | A1 * | 3/2003 | Persohn et al. | 285/39 |

* cited by examiner

*Primary Examiner* — Len Tran
*Assistant Examiner* — Viet Le
(74) *Attorney, Agent, or Firm* — Fitzpatrick, Cella, Harper & Scinto

(57) ABSTRACT

A mounting system for securing inverted bottles to a refrigerated dispensing apparatus housing, which system includes a valve body with external locking splines and grooves to secure a bottle to which it is threadedly connected to a socket in the housing having mating splines and grooves.

14 Claims, 5 Drawing Sheets

BOTTLE MOUNTING ASSEMBLY FOR REFRIGERATED DISPENSERS

This invention relates to an improved bottle mounting system for machines for dispensing chilled beverages from inverted beverage containers, particularly to machines which include a refrigeration cooling unit and a beverage delivery tube which is cooled by the refrigeration cooling unit.

BACKGROUND OF THE INVENTION

Bar top refrigerating-dispensing apparatus has become well known and very popular in the restaurant industry for displaying an alcoholic beverage to be dispensed to customers while simultaneously providing a chilling apparatus and a dispenser for dispensing the chilled alcoholic beverage on site simply and efficiently.

Examples of bar top dispensing apparatus are the subject matter of a series of U.S. patents, namely, U.S. Pat. Nos. 5,494,195; 5,456,387; and 5,427,276, the disclosures of which are incorporated by reference herein.

The apparatus disclosed in the aforementioned patent disclosures all include a housing which generally encloses the refrigeration apparatus and mounts a dispensing spigot on one face thereof with an activating mechanism, typically a handle or lever-type paddle to turn a faucet on and off for the purposes of dispensing a beverage such as a chilled liqueur, and importantly for the purposes of promoting the sale of the dispensed liquor, includes a series of inverted bottles of the particular beverage being chilled and dispensed.

It is to a new and improved mounting of inverted beverage containers that the present invention is specifically directed.

SUMMARY OF THE INVENTION

Whereas the prior art dispensing devices typically utilized metal racks to hold the inverted bottles firmly in place on top of the refrigerated dispensing unit, the necessity of using such a metallic rack or retainer is eliminated by the provision for each of the beverage bottles of a simple spring-loaded valve which is threaded on to the bottle replacing the bottle cap. On its exterior surfaces, the valve has a series of spline-like projections separated by grooves extending completely about the valve.

In accordance with the invention, the locking-mounting valve is threaded onto the top of the bottle before it is inverted after the cap of the bottle is removed to seal the bottle contents. When it is desired to mount the bottle onto the refrigerating unit, the bottle is simply inverted and inserted into a mating socket receptacle on the top of the dispensing unit, which receptacle has mating grooves and splines arranged in the same configuration as that of the mounting valve to permit the splines to be firmly inserted and secured in the receptacle grooves by a force fit when the bottle is inverted and inserted therein.

In accordance with the invention, when the inverted bottle is so placed into the unit and secured therein, the spring-loaded valve will be engaged, depressed and opened by an activating pin to permit the flow of beverage by gravity into the unit for cooling. More specifically, the sockets may be formed as part of a manifold assembly into which a plurality of inverted beverage bottles having the new mounting valves may be mounted.

For a more complete understanding of the present invention and its attendant advantages, reference should be made to the following detailed description of the invention taken in conjunction with the accompanying drawings.

DETAILED DESCRIPTION OF THE INVENTION

Figure 2:
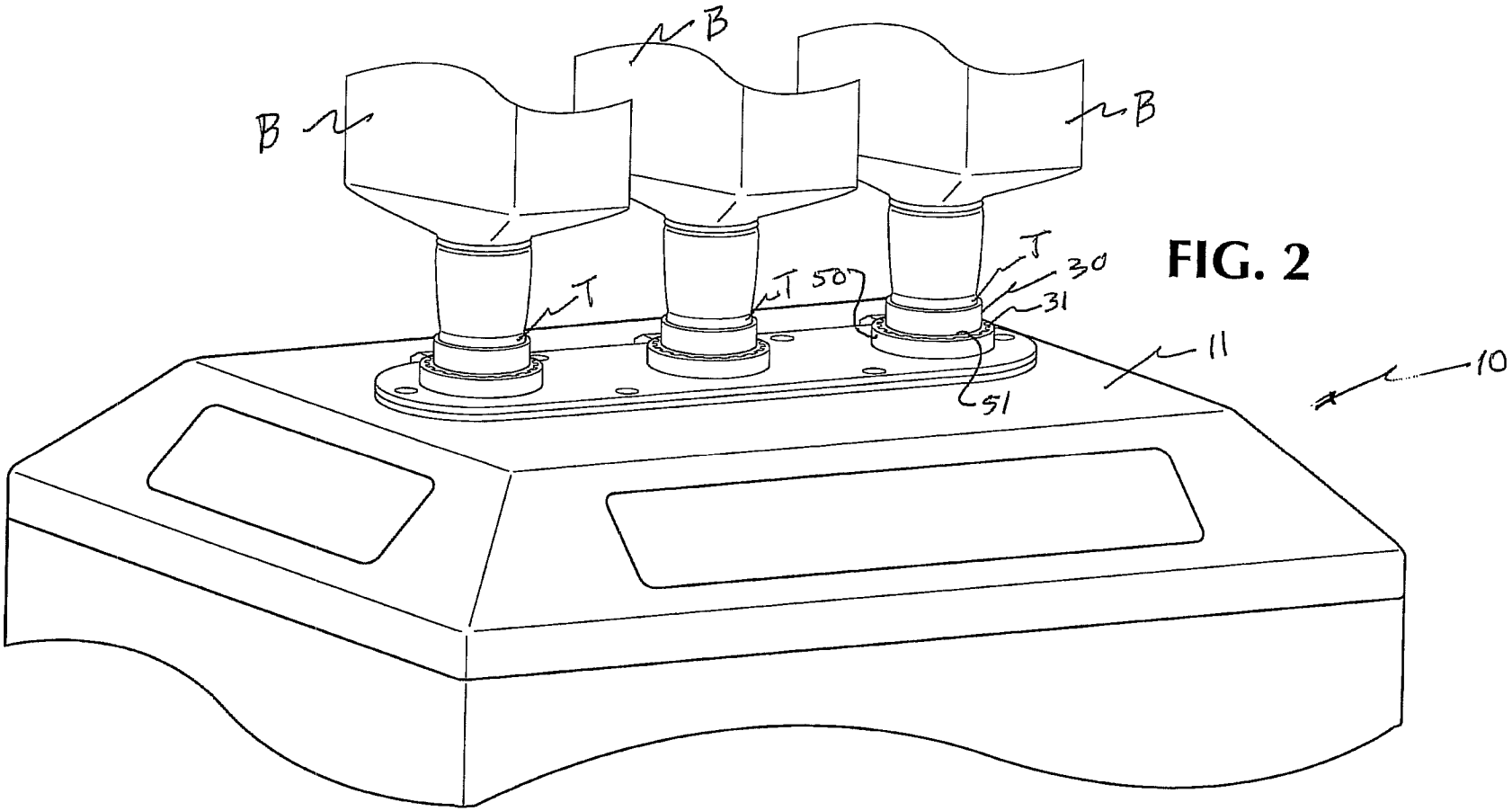
FIG. 2 is a partial perspective view showing the manner in which a series of inverted bottles is mounted on the top of a bar top refrigerated dispensing unit.
Figure 3:
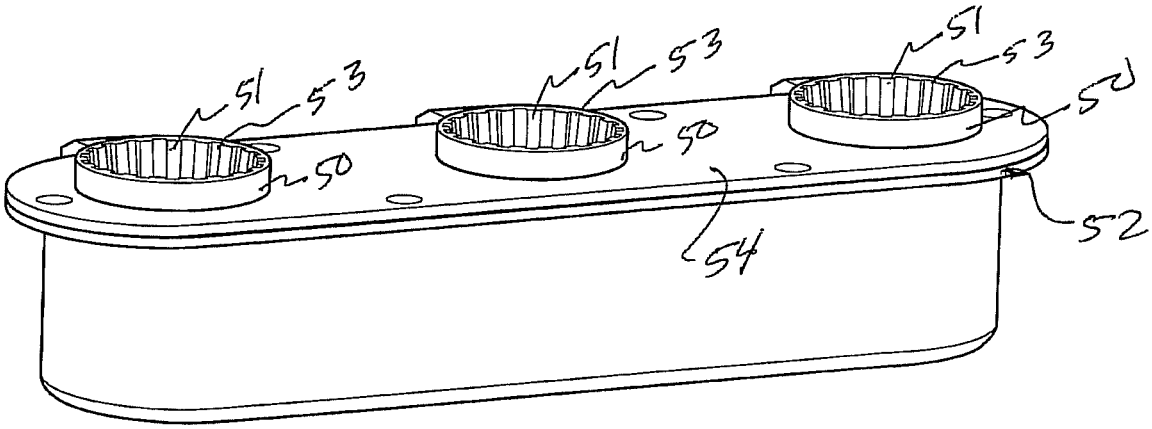
FIG. 3 is a perspective view of the subassembly of the bottle locking plate mounted on the beverage manifold.
Figure 4:
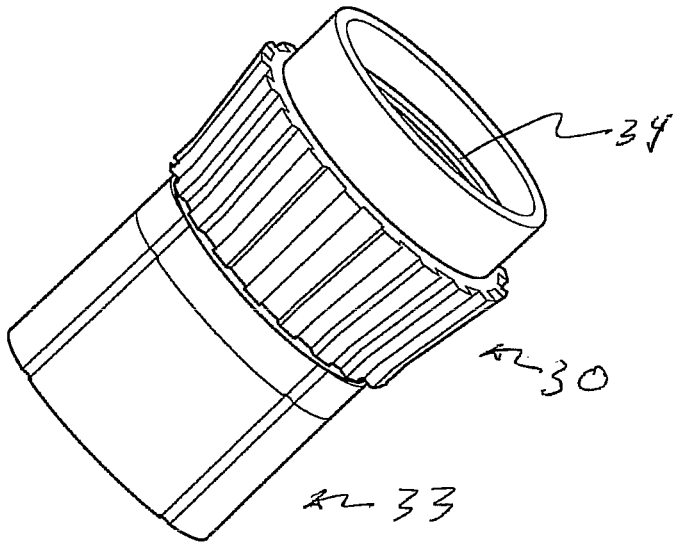
FIG. 4 is a perspective view of the valve assembly with its circumscribing locking splines.

Referring now to FIG. 2, the bottle mounting arrangement of the present invention is adapted to be incorporated into a bar top refrigerated dispenser 10 of the type having a housing 11 in which housing cooling mechanism (not shown) is enclosed and on one of the outer surfaces of the housing a dispensing faucet is mounted (not shown) and which dispenser is charged with liquid by inverting and mounting one or more bottles B on the top of the housing 11. The display of the bottle serves to promote the sale of the beverage.

In accordance with the invention, the beverage bottles are provided with mounting-locking valves 30 which are threaded onto the bottles after the threaded bottle caps are removed. The valves 30 are spring-loaded into a normally closed position and have a splined, grooved exterior surface 31.

To charge the dispenser 10, the bottles B with the valves 30 attached are inverted and inserted into a receptacle 50 having a mating splined/grooved surface 51. The bottles B will be firmly secured to the housing by virtue of the engagement of the valve body splines/grooves with the associated splines/grooves of the receptacle at the top of the dispenser housing.

Figure 1:
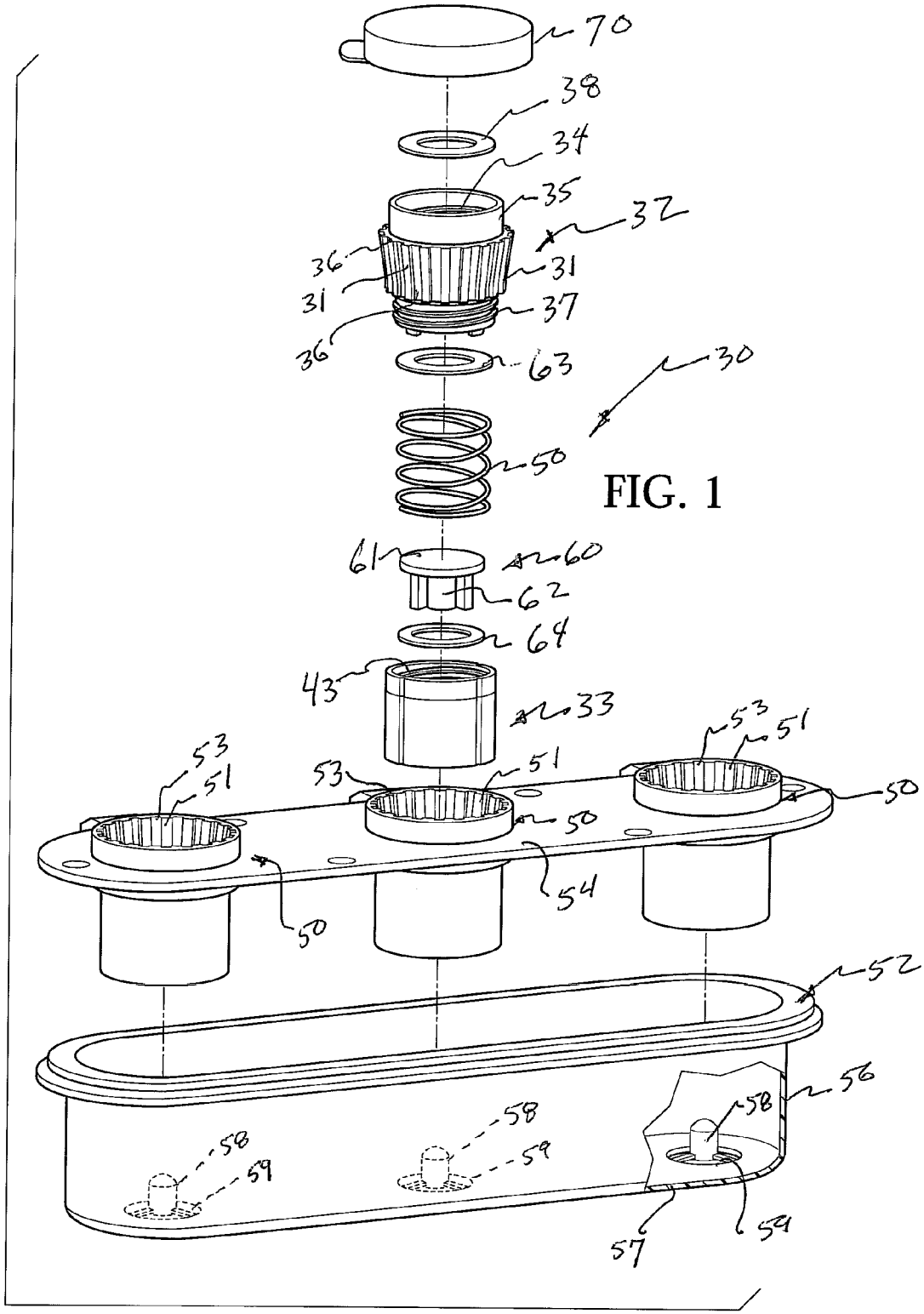
FIG. 1 is an exploded view of the valve components and the receptacle and manifold components of the new bottle mounting arrangement of the invention.
Figure 5:
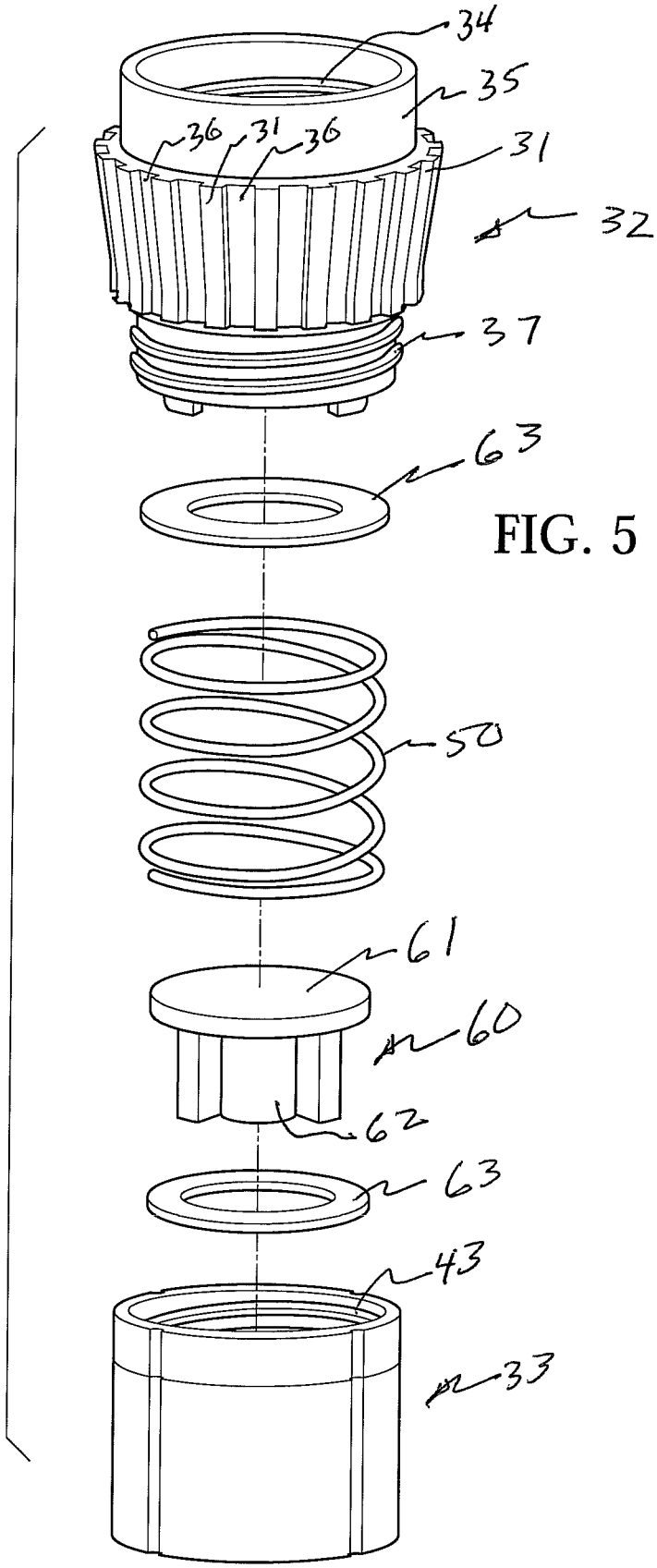
FIG. 5 is an exploded perspective view of the elements of the new valve assembly itself.

Referring to FIGS. 1 and 5, the locking-mounting valve elements are shown in the relation to an inverted beverage bottle such as illustrated in FIG. 2.

The locking-mounting valve 30 has an upper valve body 32 and a lower valve body 33. The valve body 32 has a cylindrical collar 35 with internal threads 34 which are adapted to threadingly engage the bottle top threads T (FIG. 2) which are exposed upon the opening of the bottles B by rethreading their factory-installed caps. Washer 38 seals the connection of bottle B to the threads 34.

In accordance with the invention, a frusto-conical array of upper locking splines 31 separated by upper locking grooves 36 are formed integrally with the outer surfaces of the valve body 32. The upper splines 31 taper in width from top-to-bottom while the upper grooves therebetween correspondingly taper from bottom-to-top.

Figure 6:
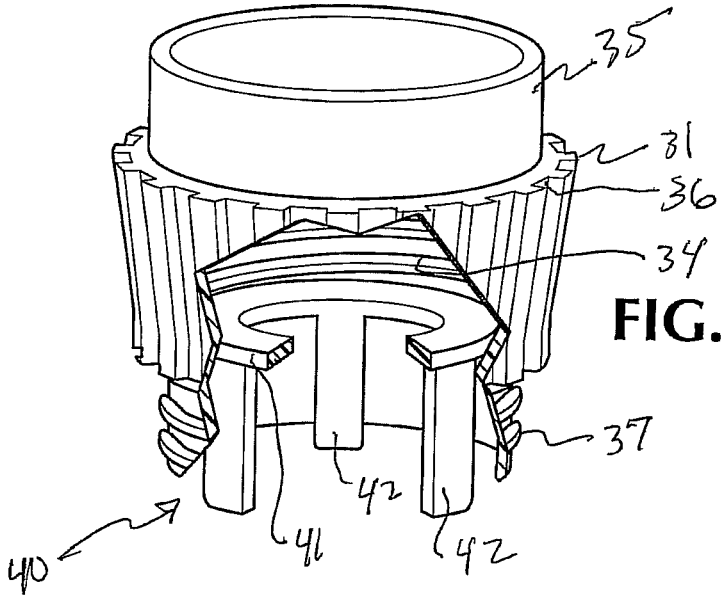
FIG. 6 is a perspective view of the upper molded mounting-locking valve element with portions removed to show inner details.

The upper valve body 32 has an exterior threaded surface 37 below the locking splines 31 and grooves 36. Disposed within the upper valve body is a spring retainer 40 having an annular top 41 and depending legs 42 (FIG. 6).

Figure 7:
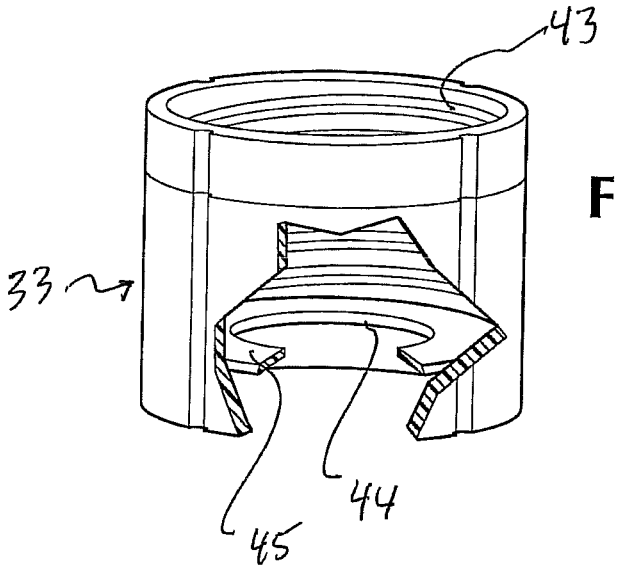
FIG. 7 is a perspective view of the lower molded mounting-locking valve element with portions removed to show inner details.

The lower valve body 33 includes threads 43 adapted to engage upper valve body threads 37 in the assembly of the locking-mounting valve elements. A valve orifice 44 is formed in annular orifice plate 45 formed integrally with the lower valve body 33 (FIG. 7).

The locking-mounting valve assembly 30 is completed by inserting a coil biasing spring 50 in the annular space between the legs 42 and the lower extremity of the upper valve body 32 so that it will engage the valve stopper 60, which has an annular stopper disc 61 of greater diameter than that of orifice 44 and a projecting actuator tab 62.

Sealing elastomeric washer 64 rests on the orifice 44 and seats the stopper disc 61. Sealing elastomeric washer 63 is disposed over threads 37 when the upper and lower body elements 32, 33 are threaded together by threads 37, 43 with the spring 50 biasing the stopper 60 into a normally closed position.

In accordance with the invention, a series of locking sockets 50 associated with a manifold 52 is secured to the top of the dispenser housing 11. The sockets 50 are generally cylindrical in shape, having a frusto-conical array of lower locking splines 51 separated by lower locking grooves 53. The lower locking splines 51 and lower locking grooves 53 are configured to mate with the upper locking splines 31 and locking grooves 36 in a secure force fit to mount inverted bottles B on the housing wall 11.

The sockets 50 may be formed integrally with or otherwise attached to cover plate 54 which serves to close the manifold 52. The manifold has vertical side walls 56 and a bottom wall 57 mounting rigid vertical pins 58 adapted to engage and displace the actuator tab 62 of the valve stopper 60. Exit ports 59 are formed in the wall 57 to permit the beverage from the inverted bottles to travel through the housing to be refrigerated and dispensed. Removable caps 70 for covering the sockets 50 before bottles B are mounted are also provided.

It will be appreciated that the new and improved bottle mounting assembly of the present invention provides a simple and efficient system for mounting an inverted bottle to a refrigerated beverage dispenser of the general type shown in U.S. Pat. Nos. 5,494,195; 5,456,387; and 5,427,276 without external racks or frames. Moreover, the new mounting hardware may be fabricated from lightweight thermoplastic materials to reduce the weight and costs of the finished dispensers.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A bottle mounting valve assembly for a fluid dispenser, comprising:

(a) a fluid reservoir manifold with a cover plate, the cover plate having at least one locking socket with locking grooves formed in a frusto-conical arrangement; and (b) a valve body having a top and a bottom, the valve body further providing:

(i) a threaded portion on the interior surface of an upper portion of the valve body for threadingly engaging an inverted bottle;

(ii) an axially displaceable stopper provided within a cylindrical lowermost portion of the valve body;

(iii) a biasing spring in a space beneath the upper portion of the valve body that engages with an upper side of the displaceable stopper;

(iv) a discharge orifice that is normally closed by the displaceable stopper; and (v) a frusto-conical array of locking splines formed on the exterior surface of the upper portion of said valve body, said locking splines tapering from the top of said valve body towards the bottom of said valve body, and engaging with the locking grooves of the at least one locking socket, wherein the locking grooves of the at least one locking socket correspondingly taper from the bottom of said fluid reservoir manifold towards the top of said fluid reservoir manifold, whereby said inverted bottle is rigidly secured to said fluid reservoir manifold when said locking splines of said valve body engage said locking grooves of the at least one locking socket, wherein said valve body is covered by a cap when not threadingly engaging an inverted bottle.

2. The valve assembly according to claim 1, further comprising a refrigerated beverage dispensing apparatus having a housing with a top, wherein the fluid reservoir manifold is secured at the top of said housing.

3. The valve assembly of claim 2, in which said valve assembly includes a lower wall defining the discharge orifice and the displaceable stopper is mounted for axial displacement in a collar and normally engages said orifice to close the valve;

said biasing spring urges said stopper against said lower wall, wherein said stopper comprises a stopper disk; and said stopper is displaceable away from said lower wall to open the valve when said inverted bottle is mounted to said apparatus.

4. The valve assembly of claim 3, in which an opening pin is mounted in said manifold and adapted to engage said stopper to open said valve.

5. The valve assembly of claim 2, in which said locking splines and said grooves are tapered in width.

6. The valve assembly of claim 5, which does not comprise an external bottle support rack.

7. The valve assembly of claim 1, wherein the upper side of said displaceable stopper comprises a stopper disc, such that the biasing spring urges said displaceable stopper against said discharge orifice.

8. The valve assembly of claim 7, in which the upper and lowermost portions of said valve body are threadedly interconnected;

said stopper disc is of greater diameter than said orifice and includes an actuator tab projecting outwardly from said orifice; and said valve body centers said biasing spring.

9. The valve assembly of claim 1, in which said locking splines and said grooves are tapered in width.

10. The valve assembly according to claim 1, further comprising a refrigerated beverage dispensing apparatus having a housing with a top, wherein the at least one locking socket is disposed in said housing.

11. The valve assembly of claim 10, in which said locking splines and said grooves are tapered in width.

12. The valve assembly of claim 11, which does not comprise an external bottle support rack.

13. The valve assembly of claim 10, in which said valve assembly includes a lower wall defining the discharge orifice and the displaceable stopper is mounted for axial displacement in a collar and normally engages said orifice to close the valve;

said biasing spring urges said stopper against said lower wall, wherein said stopper comprises a stopper disc; and said stopper is displaceable away from said lower wall to open the valve when said inverted bottle is mounted to said apparatus.

14. The valve assembly of claim 1, in which an opening pin is mounted in said manifold and adapted to engage said stopper to open said valve.

* * * * *